US010299331B2

(12) United States Patent
Tousain et al.

(10) Patent No.: US 10,299,331 B2
(45) Date of Patent: May 21, 2019

(54) LED RETROFIT DRIVER CIRCUIT AND METHOD OF OPERATING THE SAME

(75) Inventors: Robertus Leonardus Tousain, Eindhoven (NL); Redouane Eddeane, Utrecht (NL); Dennis Johannes Antonius Claessens, Eindhoven (NL); Philip Louis Zulma Vael, Temse (BE); Jack Jiang, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 376 days.

(21) Appl. No.: 14/117,047

(22) PCT Filed: May 14, 2012

(86) PCT No.: PCT/IB2012/052384

§ 371 (c)(1),
(2), (4) Date: Aug. 29, 2017

(87) PCT Pub. No.: WO2012/156891

PCT Pub. Date: Nov. 22, 2012

(65) Prior Publication Data

US 2018/0035503 A1 Feb. 1, 2018

(30) Foreign Application Priority Data

May 18, 2011 (EP) ..... 11166616

(51) Int. Cl.
*H05B 33/08* (2006.01)
*F21K 9/23* (2016.01)
*H05B 39/04* (2006.01)

(52) U.S. Cl.
CPC ..... *H05B 33/0845* (2013.01); *F21K 9/23* (2016.08); *H05B 39/044* (2013.01)

(58) Field of Classification Search
None
See application file for complete search history.

(56) References Cited

U.S. PATENT DOCUMENTS

2012/0169246 A1* 7/2012 Eddeane ..... H05B 33/0842 315/276

FOREIGN PATENT DOCUMENTS

WO 9907188 A2 2/1999
WO 2008001246 A1 1/2008
(Continued)

*Primary Examiner* — Dedei K Hammond
(74) *Attorney, Agent, or Firm* — Akarsh P. Belagodu

(57) ABSTRACT

A LED retrofit driver circuit (3) is provided, comprising at least an input (6) for receiving an operating voltage from a power supply (2), an output (8) for connection to one or more LED units (5), a power converter (7) connected with said input (6) and said output (8) and configured to provide a lamp current (50) at said output (8) during operation in at least a first and a second operating state. To provide a versatile circuit (3), allowing operation with a variety of power supplies and under various load conditions, in said first operating state, the power converter (7) is adapted to switch between a high current generating mode (40), in which the power converter (7) is configured to draw current pulses from said power supply (2) to provide a first average input current (33*a*), and an OFF mode (42) in which no current is drawn from said power supply (2). In said second operating state, said power converter (7) is adapted at least to operate in a low current generating mode (41), in which the power converter (7) is configured to draw a current from said power supply (2) to provide a second average input current (33*b*) which is lower than said first average input current (33*a*).

13 Claims, 4 Drawing Sheets

(56) References Cited

FOREIGN PATENT DOCUMENTS

| | | | |
|---|---|---|---|
| WO | 2010005291 | A1 | 1/2010 |
| WO | 2011033415 | A1 | 3/2011 |

* cited by examiner

LED RETROFIT DRIVER CIRCUIT AND METHOD OF OPERATING THE SAME

FIELD OF THE INVENTION

The invention relates to the field of lighting and particularly to an LED retrofit driver circuit and a method of operating a LED retrofit driver circuit.

BACKGROUND OF THE INVENTION

Present developments in the field of lighting aim to replace common lighting devices, such as incandescent or halogen lamps, by retrofit lamps using light emitting diodes (LEDs). Such LED retrofit lamps exhibit reduced power consumption at a comparable luminous flux and an increased lifetime and are thus employed to increase the efficiency of lighting applications and to conserve electrical energy.

While the reduced power consumption of LEDs is beneficial to conserve energy, problems arise from the fact that the reduced power consumption results in an accordingly reduced operating voltage and current. For example, when an LED retrofit lamp is operated with a conventional power supply, such as an electronic transformer as used in halogen lighting systems, the transformer may have a minimum load requirement, which typically cannot be met by a LED retrofit lamp because of its much lower power consumption. Below said minimum load level, the operation of the electronic transformer may be unstable or result in no current being supplied to the lamp.

Although it is possible to adapt the LED lamp and increase the power consumption e.g. by increasing the number of LEDs used or by adding one or more resistors to the circuitry of the lamp, an increase of the power consumption certainly is prejudicial to the efficiency of the device and thus to the present efforts to conserve energy.

Document WO 2011/033415 of the present applicant provides a solution to the above problem. The device allows operating LEDs with a power supply having a minimum load requirement, such as an electronic transformer.

The document discloses an illumination device having a three-stage setup and a low-power light source, e.g. a light emitting diode. The disclosed device further comprises a power input stage using a boost converter, which boost converter is configured to draw current pulses from the power supply. During the pulses, the current level is high enough to meet the minimum load requirement of the transformer, so that electrical energy can be transferred to the illumination device. The power input stage is switched between a current generating mode and an OFF mode to set the power transferred to the lamp.

While the disclosed illumination device advantageously allows operating an LED light source with a power supply having a minimum load requirement, the present inventors recognized that the electrical efficiency may not be optimal under all operating conditions.

Therefore, it is an object of the present invention to provide an enhanced LED retrofit driver circuit on the basis of the disclosed setup, providing increased efficiency under a multitude of operating conditions.

SUMMARY OF THE INVENTION

The object is achieved by a LED retrofit driver circuit according to claim 1, a LED retrofit lamp according to claim 12, a LED retrofit lighting system according to claim 13 and a method of operating a LED retrofit driver circuit according to claim 14.

The basic idea of the invention is to provide a LED retrofit driver circuit, which allows driving light emitting diodes in multiple operating states to allow efficient operation of the inventive driver circuit with a variety of power supplies and/or under various load conditions. The inventive driver circuit thus is highly versatile.

In a first of said operating states, the driver circuit is adapted to switch between a high current generating mode, in which current pulses are drawn from a connected power supply to provide a first average input current, and an OFF mode, in which no substantial current is drawn from the power supply. In a second of said operating states, the driver circuit is adapted at least to operate in a low current generating mode, in which a current is drawn from said power supply to provide a second average input current. The aforementioned second average input current is lower than the first average input current.

The operation according to the first operating state provides a high input current, which—in dependence on the setup of the driver circuit—may typically result in a high output or lamp current. The operation according to this mode may be used when the respectively connected power supply has a relatively high minimum load requirement and/or when a high output lamp current is needed, e.g. in the case that multiple LEDs are connected to the circuit.

The operation according to the second operating state provides a relatively low input and e.g. lamp current, in particular when the respectively connected power supply has a low or no minimum load requirement and/or for low power applications or for example in the case that the connected LEDs are in a dimmed state.

While the LED retrofit driver circuit may thus be used in a variety of applications, e.g. requiring a relatively high lamp current, it is also possible to use the driver circuit in applications requiring a relatively low lamp current. Furthermore, the second operating state advantageously provides an increased current flow angle, since in this state the aforementioned OFF mode of said first operating state is omitted. Thus, the present invention provides an operating state having an increased power factor, which enhances the efficiency of the overall setup in this operating state.

The present invention is based on applicant's prior published patent application WO 2011/033415, incorporated herein by reference. The operation according to the prior application mainly corresponds to the operation of the inventive LED retrofit driver circuit according to the first operating state, which is typically used in the case that the driver circuit is connected with a power supply having a relatively high minimum load requirement.

According to the invention, the LED retrofit driver circuit comprises at least an input for receiving an AC or DC operating voltage, in particular an operating voltage from a power supply. An output is provided for connection to one or more LED units.

Furthermore, a power converter is provided, connected at least with said input and said output and configured to provide a lamp current at said output during operation. The power converter is configured for operating at least in a first and a second operation state, wherein in said first operating state, the power converter is adapted to switch between a high current generating mode, in which the power converter is controlled to draw current pulses from said power supply to provide a first average current, and an OFF mode, during which no substantial current is drawn from said power supply.

In the second operating state, said power converter is adapted at least to operate in a low current generating mode, in which the power converter is controlled to draw a current from said power supply to provide a second average input current, lower than said first average input current.

As discussed above, the LED retrofit driver circuit comprises at least an input for receiving said operating voltage from the power supply and said output for connection to one or more LED units.

The input and the output may be of any suitable type to allow a connection to the power supply and said one or more LED units, respectively, and e.g. comprise each two electric terminals, such as connecting pins, solder pads, bond wire pads or any other suitable connector or plug to allow establishing a corresponding electrical connection. The input and the output may certainly comprise further components or circuits. For example, the input may e.g. comprise a rectifier for providing a unipolar operating voltage to the power converter. Correspondingly, the output may comprise for example a filter device for smoothing the voltage and/or the current delivered to the one or more LED units. Alternatively or additionally, the input and/or the output may comprise further mechanical components such as, for example in the case that the LED retrofit driver circuit is provided so as to be removable from power and/or the LED units, at least one correspondingly separable electric connector. Most preferably, the input and/or the output are integrated with a lamp socket, such as a typical lamp socket.

As discussed above, the input is adapted for receiving an operating voltage from a power supply. According to the present invention, the power supply may be an AC mains line or an electric or electronic transformer. The operating voltage may e.g. correspond to an AC voltage, i.e. from a 110 V or 220 V mains connection. It is however preferred that the operating voltage is a safety low voltage, i.e. equal to or below 42 V, most preferably equal to or below 25V or 14V.

It is especially preferred that the operating voltage is a variable voltage. In the present context, the term "variable voltage" refers to a voltage varying over time. The variable voltage may be a periodic voltage or an alternating voltage; however and most preferably, the variable voltage is a unipolar periodic voltage, such as e.g. a rectified alternating or periodic voltage.

As discussed above, the LED retrofit driver circuit according to the invention comprises an output for connection to one or more LED units. The output may be of any suitable type allowing an electric connection to said one or more LED units to be established, as discussed above. Preferably, the output comprises a separable electric connector, so that it is possible to detach the LED retrofit driver circuit from the LED units. In the case of a connection of more than one LED unit, the respective LED units may be connected in series with and/or parallel to each other. Certainly, it is possible that the one or more LED units are connected with said output through intermediate components, for example a buffer stage.

The LED units may be of any suitable type and comprise at least one light emitting diode (LED), which in terms of the present invention may be any type of solid state light source, such as an inorganic LED, organic LED or a solid state laser, e.g. a laser diode. The LED unit may certainly comprise more than one of the aforementioned components connected in series and/or in parallel.

For general lighting applications, the LED unit may preferably comprise at least one high-power LED, i.e. having a luminous flux of more than 1 lm. Preferably, said high-power LED provides a luminous flux of more than 20 lm, most preferrably more than 50 lm.

The LED unit may certainly comprise further electric, electronic or mechanical components, such as for example a driver unit, e.g. to set the brightness and/or color, a smoothing stage, and/or one or more filter capacitors.

The inventive LED retrofit driver circuit further comprises said power converter, as discussed above. The LED retrofit driver circuit may certainly comprise further components, such as a housing, one or more disconnectable lamp sockets or connectors, one or more further LEDs, a smoothing stage, a buffer stage, a dedicated further lamp driver, associated with one or more of the LED units, and/or further control circuitry.

The power converter according to the inventive driver circuit may be of any suitable type to provide said lamp current at said output when the input of the LED retrofit driver circuit is connected with power, i.e. during operation when the input is supplied with said operating voltage from a suitable, connected power supply. The power converter may be integrated with further components of the inventive retrofit driver circuit e.g. the input and/or output, or may be provided as a separate unit.

The power converter allows operation at least in said first and second operating states. Certainly, it is possible that the power converter is operable in more than said two operating states.

To control the respective operation, the power converter may e.g. comprise a suitable control unit, formed from integrated circuitry, such as a microprocessor or a suitable computing device. Alternatively or additionally, the control unit may comprise discrete electronic components to allow operation at least in said first and second operating states.

As discussed above, and according to the first operating state, the power converter is adapted to switch between a high current generating mode and an OFF mode. In the OFF mode, no current is drawn from the power supply. It should be noted, however, that a minor idle current in the range of milliamperes may be present even in the OFF mode, e.g. below 5 mA.

In the high current generating mode, the power converter is adapted to draw current pulses from said connected power supply to provide a first average input current. The driver circuit in the present mode thus may provide an intermittent load to the connected power supply, so that a current flows from the power supply to the power converter of the inventive driver circuit, providing said first average input current.

In the context of the present invention, the term "current pulse" refers to a varying or discontinuous current, where the current varies over time at least between distinct low and high levels. For example, the current may vary between approximately OA and a defined pulse amplitude to obtain said average input current. The term "average input current" refers to the average current at the input over time during the first and second current generating modes, respectively.

As discussed above, the power converter of the inventive LED retrofit driver circuit further allows operation in the second operating state, in which the power converter is adapted to operate in a low current generating mode. In said low current generating mode, the power converter is adapted to draw a current from said power supply to provide a second average input current, which is lower than said first average input current.

The low average input current may result in a correspondingly reduced lamp current, disregarding a possible energy storage element connected between power converter and LED unit, such as a capacitor or an inductor. Accordingly, the second operating state thus can be referred to as "low power mode", e.g. for dimming purposes. While in the first operating state, the pulse operation in the high current generating mode is superimposed by switching between the current generating mode and the OFF mode, i.e. in said first operating state, phases in which the power converter is in "pulse operation" alternate with phases in which no current is drawn from the power supply (OFF mode); this is not necessarily the case in the second operating state. Accordingly, the current conduction angle, i.e. the time that a current is drawn in each half-cycle of the alternating or recurrent variable operating voltage, is higher in the second one of said at least two operating states. Thus, the power factor and the electrical efficiency advantageously are increased when operation takes place in said second state.

The present invention accordingly allows operating the driver circuit with a variety of different power supplies, such as electronic transformers, in an efficient way. The inventive LED retrofit driver circuit therefore is highly versatile and enhances the electrical efficiency, thereby conserving electrical energy.

The inventive driver circuit may e.g. be used in combination with an above mentioned power supply or electronic transformer having a relatively high minimum load or current requirement according to the operation in the first operating state.

In the case that the respective, connected power supply or electronic transformer does not have a minimum load requirement or has a relatively low minimum load requirement, the inventive driver circuit advantageously allows operating the LED units using such power supply with enhanced efficiency according to the second operating state. To set the respective operating state, the power converter may comprise a corresponding switch, so that the operating state can be set manually during installation in dependence on the respective power supply used. Alternatively or additionally, a detector may be present to determine the type of power supply.

The LED retrofit driver circuit according to the invention allows setting the average input current according to the high and low current generating modes, as mentioned above. The first and second average input current may be chosen according to the application, however, it is preferred that the first average input current is equal to or higher than the minimum load or current requirement of typical power supplies, such as electronic transformers. The second average input current preferably corresponds to the current required to operate the one or more LED units connected to said output.

While in said high current mode, the power converter is configured to draw current pulses from the connected power supply, in said low current mode, the power converter may be configured to draw a continuous current from the power supply to provide said second, low average input current.

According to a development of the invention, the power converter in said low current generating mode is configured to draw current pulses from said power supply to provide said second average input current.

The present embodiment simplifies the operation, since in said low current generating mode the operation corresponds to the operation in the high current generating mode with the exception of a lower average input current and the use of said OFF mode. To provide said second, low average input current, the average pulse amplitude in said low current generating mode should preferably be lower than the average pulse amplitude in said high current generating mode.

As discussed above, the power converter, when configured to draw current pulses, i.e. during pulse operation, draws a varying or discontinuous current from said power supply. While in general, the current may vary between approximately OA and the above mentioned pulse amplitude, according to an embodiment of the invention, the power converter in said high and/or low current generating mode is configured to alternate between a high and low input current level to provide said first and/or second average input current.

The present embodiment of an alternation between high and low input current levels, which are different from a zero or OFF level, i.e. zero mA, is particularly advantageous to allow an enhanced pulse frequency, which, in the present context, is the frequency of the alternation between said high and said low input current. Preferably, the power converter is configured for hysteresis operation, i.e. by having said high and low input current levels show a suitable difference in current. More preferably, the high and low input currents show a difference of at least 200 mA, and it is particularly that said difference is at least 350 mA.

Certainly, the high and low input current levels and the pulse frequency should be adapted to provide the respective first and/or second average input current. In the case of an alternating or periodic input operating voltage, the pulse frequency should preferably be higher than the frequency of said periodic variable operating voltage. More preferably, the pulse frequency is higher than 100 kHz, and it is particularly preferred to be higher than 300 kHz to provide a constant lamp current.

As discussed above, the power converter may be of any suitable type to allow the above-mentioned pulse operation. For example, the power converter may comprise a switchable energy storage element, e.g. a reactive element, such as an inductor. The energy storage element may be intermittently connected with the power supply and the LED units to provide said pulsed operation. Alternatively or additionally, the power converter may comprise a linear power source to provide said pulse operation Preferably, the power converter comprises a step-up converter, such as a boost converter, a buck-boost converter, a SEPIC or any other suitable type of converter. While, typically, a step-up converter is used to increase the voltage, so that the voltage at the output is higher than the input voltage, such a converter may be advantageously used to provide a relatively constant low output current from a higher input current, such as provided by the operation according to the aforementioned high and low current generating modes.

According to a further preferred embodiment of the invention, the power converter in said second operating state is further adapted to switch between said low current generating mode and said high current generating mode.

The present embodiment allows improved control of the lamp current in the second operating state, in particular in the case that the lamp current is to be slightly increased, e.g. during dimming. Advantageously, the present embodiment ensures that the current conduction angle and the power factor remain high.

In addition, the present embodiment allows the respective operating state of the power converter to be "automatically set" in dependence on the connected power supply. Assuming that the power supply has no or only a relatively low minimum current requirement, i.e. lower than or equal to the second average input current, the present embodiment allows operating the power converter as discussed above in said second operating state, where the power converter is set to switch between said low and said high current generating modes. When it is assumed however that the power supply has a relatively high minimum current requirement, i.e. higher than the second average input current, and that no current is provided in the case that the minimum current requirement is not met, the same switching operation of the power converter results in an operation according to said first operating state, i.e. where the power converter switches between said high current generating mode and said OFF mode.

Thus, the present embodiment advantageously enables an inherent selection of the most suitable operating state of the power converter, so that no user input is necessary and the aforementioned manual switch may be omitted.

Preferably, in the case of a periodic or alternating operating voltage, the power converter is adapted to switch between said high and said low current generating modes and/or said high current generating mode and said OFF mode in synchronization with the operating voltage, so that the switching time or switching point is substantially constant with respect to a cycle or half-cycle of said periodic operating voltage.

Most preferably, in said second operating state, the power converter is adapted to switch between said low and said high current generating modes only once per period of said periodic voltage, i.e. in the case of a rectified mains or AC voltage, once per half-cycle of said mains voltage, so that the switching frequency is lower than and/or equal to the frequency of said periodic voltage.

While, according to the above, the power converter is configured to set the current at said input to said first and second average input current, another aspect is to provide substantially constant power to the one or more LED units to enable a flicker-free light output.

In correspondence with the above, and according to another preferred embodiment of the invention, the LED driver circuit further comprises a feedback circuit connected with said power converter and configured to determine at least one electrical parameter at said output to set the mode of said power converter in dependence on said determined parameter, e.g. to switch between said high current generating mode and said OFF mode and/or between said high current generating mode and said low current generating mode, depending on said determined parameter, respectively.

According to the present embodiment, at least one electrical parameter, e.g. a current and/or a voltage, is determined to control the mode of the power converter. For example, the feedback circuit may be configured to determine a parameter corresponding to the lamp current at said output or at one of said LED units. Alternatively or additionally and in particular in the case of a buffer, such as when a capacitor is arranged between said power converter and said at least one or more LED units, the feedback circuit may be configured to determine said electrical parameter, which corresponds to the voltage across said buffer to control the mode of said power converter. Although it is preferred that the electrical parameter is directly determined at the output to provide a simple setup of the driver circuit, it is nevertheless possible to determine a parameter corresponding to the electrical parameter at the output. For example, the lamp current may also be determined by measuring the current through the connected LED units.

The feedback circuit may be of any suitable type to determine said at least one electrical parameter and may e.g. comprise a comparator to set the mode of said power converter so as to correspond to a predefined relation of the determined parameter with predefined threshold values. Preferably, the feedback circuit is adapted to set said mode of the power converter so that said lamp current and/or the current through said one or more LED units correspond to a predefined average lamp current. The predefined average lamp current may for example correspond to the nominal operating current or operating current range of the connected one or more LED units, so that the current is advantageously regulated to nominal operating conditions of the LED units.

According to a further preferred embodiment of the invention, the feedback circuit is configured to switch said power converter from said high current generating mode to said low current generating mode and/or said OFF mode, when said determined electrical parameter corresponds to a maximum threshold value. Additionally or alternatively, the feedback circuit is configured to switch said power converter from said low current generating mode and/or said OFF mode to said high current generating mode, when said determined electrical parameter corresponds to a minimum threshold value.

According to the above, the electrical parameter at said output, e.g. the current and/or the voltage, is controlled by the feedback circuit to a defined margin, i.e. within said minimum and maximum threshold values. Depending on the momentary current consumption of the one or more LED units, the duty cycle of the switching operation between the high current generating mode and the low current generating mode or the OFF mode, respectively, is set by the feedback circuit according to a hysteresis operation.

For example, when use is made of a power supply having a relatively high minimum load requirement as discussed above, the power converter is operated according to said first operating state. Accordingly, the power converter is set to the high current generating mode, until the lamp current reaches said maximum threshold value, which, in the present example, may correspond to a maximum allowable LED or lamp current. The power converter is then set to the OFF mode, until the minimum threshold value is met, corresponding to the minimum allowable lamp current. In accordance with the above, the power converter is operated according to the second operating state in the case of a connected power supply having a relatively low minimum load requirement. Here, the power converter is set to the high current generating mode, until the lamp current reaches said maximum allowable lamp current. The power converter is then set to the low current generating mode, until the minimum allowable lamp current is met.

The aforementioned maximum and minimum threshold values may be factory set and comprised in a suitable memory of said feedback circuit, for example in the case that the driver circuit is integrally formed with said one or more LED units. In particular in the latter case, the maximum and minimum threshold values may correspond to allowable boundaries with respect to the operating conditions of said LED units.

Alternatively or additionally, the driver circuit may comprise a user interface, allowing the threshold values to be set manually, e.g. according to the specific type of LED units connected or according to the desired dimming level.

Preferably, the driver circuit comprises an averaging circuit, connected with said feedback circuit and configured to set the maximum and/or minimum threshold value. The present embodiment is particularly advantageous when the driver circuit is used with a power supply, such as an electronic transformer, having randomly spaced starting pulses. In the latter case it may be possible that even if the power converter is set to the high current generating mode, the lamp current decreases further, because the switching of the power converter does not correspond with said starting pulse. To avoid this situation, the averaging circuit may be provided to determine the aforementioned electrical parameter, e.g. a parameter corresponding to the lamp current, and adapt the minimum threshold value of the feedback circuit to make sure that the parameter does not fall below the real or effectively intended minimum value.

The averaging circuit thus provides an improved "long-term" control and may comprise any kind of suitable circuitry. In particular, the averaging circuit may preferably comprise a P, PI or PID regulator. In this case, the time constant should be chosen to be small enough to regulate, within a period of said periodic or alternating voltage, i.e. in the case of a rectified mains or AC voltage, once per half-cycle of said mains voltage.

According to a second aspect of the present invention, a LED retrofit lamp is provided comprising at least a LED retrofit driver circuit and one or more LED units as described above, wherein said LED units are connected with said driver circuit. Preferably, the LED retrofit lamp comprises a housing in which the driver circuit and the LED units are arranged.

According to a further aspect of the present invention, an inventive LED lighting system comprises a LED retrofit lamp as described above and a power supply connected with the input of said LED retrofit driver circuit and having a minimum current requirement lower than said second average input current, so that, during operation, said power converter is switched between said low and said high current generating modes. Alternatively or additionally, the LED lighting system may comprise a power supply having a typical minimum load requirement higher than the second average input current. The LED driver circuit then operates in said first operating state.

In an inventive method of operating a LED retrofit driver circuit, said driver circuit comprises an input for receiving an operating voltage from a power supply, an output for connection to one or more LED units and a power converter connected with said input and said output and configured to provide a lamp current at said output during operation. In a first operating state, the power converter is switched between a high current generating mode, in which the power converter draws current pulses from said power supply to provide a first average input current, and an OFF mode, in which no current is drawn from said power supply. In a second operating state, the power converter draws a current from said power supply to provide a second average input current lower than said first average input current.

The LED driver circuit may certainly be adapted according to one or more of the above preferred embodiments.

BRIEF DESCRIPTION OF THE DRAWINGS

These and other aspects, features and advantages of the present invention will be apparent from and elucidated with reference to the description of preferred embodiments, in which.

DETAILED DESCRIPTION OF EMBODIMENTS

Figure 1:
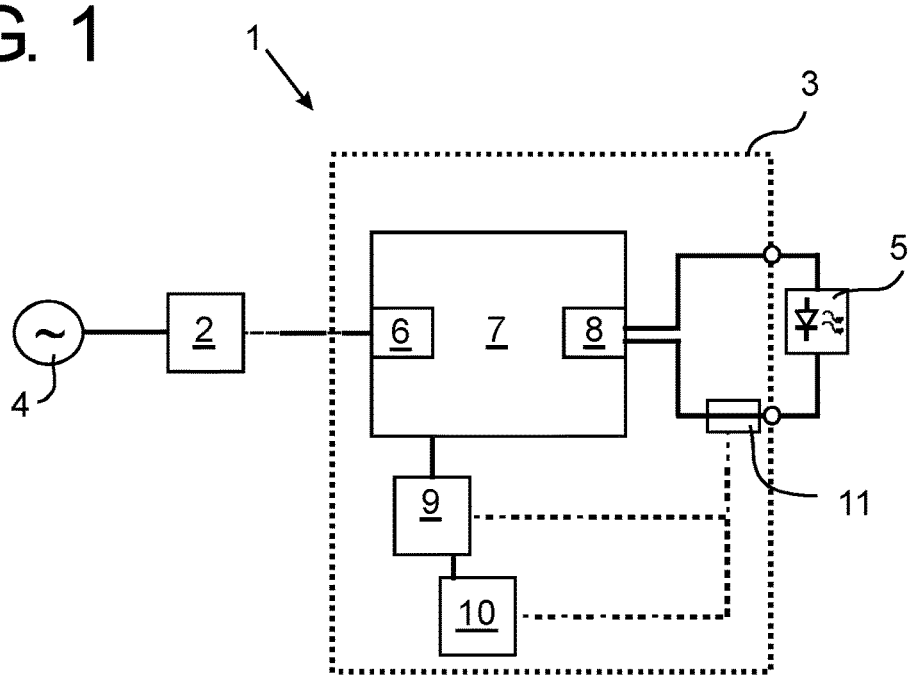
FIG. 1 shows a schematic circuit diagram of an embodiment of a LED lightning system comprising a LED retrofit driver circuit and a LED unit.

FIG. 1 shows an embodiment of a LED lighting system 1 in a schematic circuit diagram. The lighting system 1 comprises a power supply 2 which, in the present example, is connected with a LED retrofit driver circuit 3, using a separable connector as indicated by the broken line. The power supply 2 according to the present example is a 12 V electronic transformer intended for use with halogen lighting. The power supply 2 is connected with a mains line 4 to provide an alternating operating voltage of 12 V (nominal voltage) to the lighting system 1.

The LED retrofit driver circuit 3 serves to operate one or more LED units 5 with said power supply 2 in order to retrofit halogen lamps with LEDs for the purpose of conserving energy. In the present example, the LED unit 5 comprises a series connection of four high-power semiconductor light emitting diodes (not shown), each providing a luminous flux of more than 50 lm under nominal operating conditions.

The LED retrofit driver circuit 3 comprises an input 6 connected with the power supply 2 to receive the alternating 12V voltage. The input 6 provides electrical power to a power converter 7, which converts the alternating voltage of the power supply 2, i.e. the halogen transformer, and provides electrical power through a suitable output 8 to drive the LED unit 5. Although not shown in FIG. 1, the output 8 is connected with the LED unit 5 through a standard lamp socket connection, such as a G 4-type socket. According to the figure, the power converter 7 is integrally formed with input 6 and output 8 to provide a highly compact setup.

The LED retrofit driver circuit 3 further comprises a feedback circuit 9 and an averaging circuit 10, connected with each other and with the power converter 7 to control the operation of the power converter 7 as will be discussed in the following. The feedback circuit 9 and the averaging circuit 10 are connected with a detector 11, i.e. a current measurement resistor, to determine the momentary value of the current through the LED unit 5, i.e. the lamp current 50, to control the operating state of the power converter 7. Alternatively, the feedback circuit 9 and the averaging circuit 10 might be interconnected to determine a buffer voltage, in the case that a buffer, such as a capacitor, is arranged between the power converter 7 and the LEDs of the LED unit 5.

Figure 2:
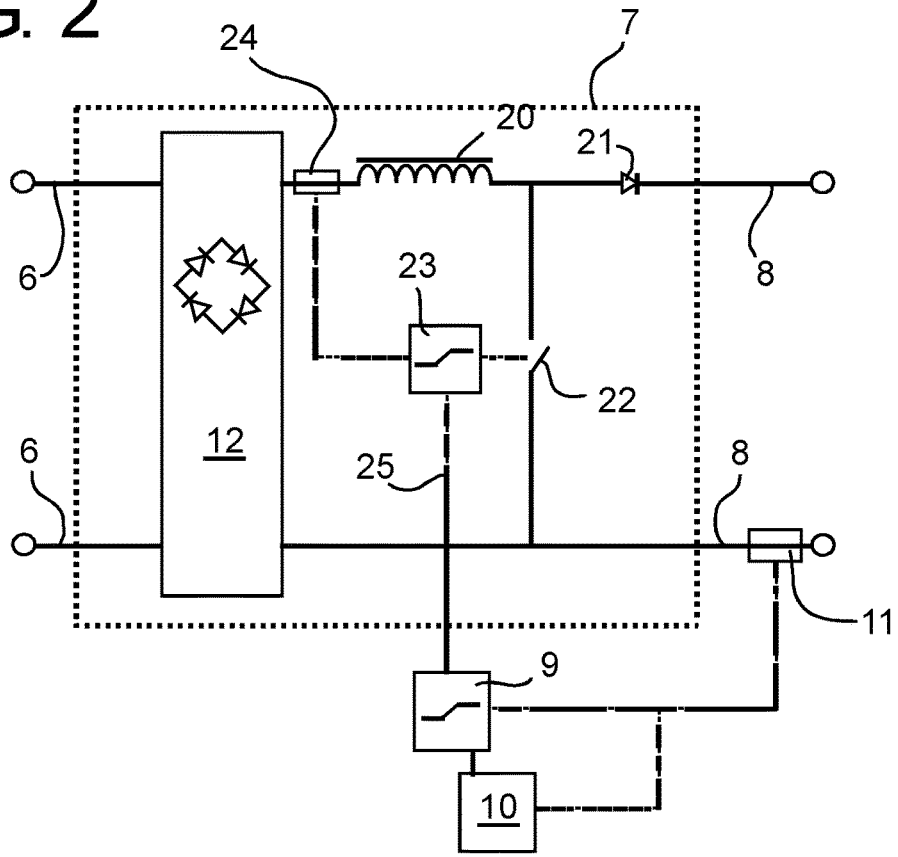
FIG. 2 shows a schematic circuit diagram of the LED retrofit driver circuit according to the embodiment of FIG. 1.

FIG. 2 shows a further, more detailed schematic circuit diagram of the power converter 7 according to FIG. 1. The power converter 7 comprises a rectifier 12 connected with the input 6, i.e. in the present example a typical bridge-type rectifier. The rectifier 12 serves to rectify the variable 12 V operating voltage supplied by the power supply 2, to provide a unipolar variable operating voltage to the further components of the LED retrofit driver circuit 3. Between the rectifier 12 and the output 8, a series connection of an inductor 20 and a diode 21 is arranged. Furthermore, the power converter 7 comprises a controllable switch 22 provided to short circuit the inductor 20. In the case of such a short circuit, the diode 21 protects the LED unit 5 from a reverse current flow, which would drain the internal capacitance of the light emitting diodes and any buffer capacitor of the LED unit 5. The controllable switch 22 according to the present example is a MOSFET, controlled by a control unit 23. The setup of the power converter 7 thus corresponds to a step-up converter and in particular to a typical boost converter design. The power converter 7 enables obtaining an output voltage at the output 8, which is higher than the input voltage, i.e. the output voltage of the power supply 2.

The operation of the power converter 7 in general corresponds to the operation of a typical boost converter. When the switch 22 is ON, i.e. in the closed state, the power supply 2 provides a current of increasing magnitude that is used to charge the inductor 20. When the switch 22 is OFF, i.e. in the open state as shown, the inductor 20 provides a current at the output 8 of decreasing magnitude. Accordingly, it is possible to transfer energy from the charged inductor 20 to the LED unit 5.

The switch 22 according to the present embodiment is controlled by control unit 23, as discussed above. Control unit 23 comprises a comparator circuit and controls the switch 22 according to the input or inductor current to provide an average input current. Therefore, the control unit 23 is connected with an input current detector 24 to obtain the momentary value of the operating input current. The respective average input current level, according to which the control unit 23 controls the switch 23, is set by the feedback circuit 9 over a setpoint line 25.

The control unit 23 controls the switch 22 according to an "inner" hysteresis so that current pulses are drawn from the power supply 2. The operation of the control unit 23 will become apparent from FIG. 3, which shows a schematic graph of the input current of the LED retrofit driver circuit 3 according to FIG. 2.

Figure 3:
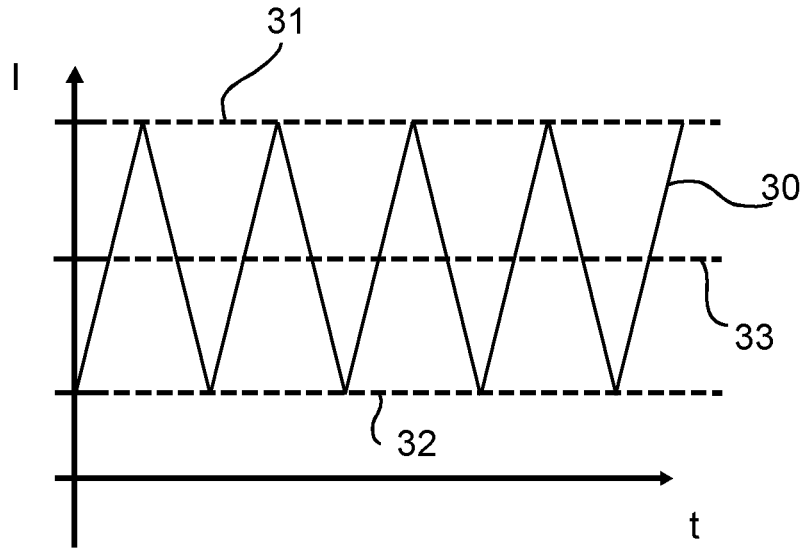
FIGS. 3 and 4 show schematic graphs of the input current of the LED retrofit driver circuit according to FIG. 2 when a power converter of said driver circuit operates in a high and/or low current generating mode.

FIG. 3 shows the waveform of the input current 30 over time. It is noted that FIG. 3 shows the input current 30 in a rather enlarged and schematic view; typically, the control unit 23 will control the switch 22 at a switching frequency of about 300 kHz or higher.

When the LED retrofit driver circuit 3 is connected to power, the control unit 23 controls the switch 22 to the ON-mode, so that the input current 30 increases. When the input current reaches a predefined high input current level 31, the switch 22 is set to the OFF-mode, so that the input current 30 accordingly decreases. Once the low input current level 32 is reached, the controllable switch 22 is set to the ON-mode and the input current 30 accordingly increases again.

The aforementioned operation is correspondingly repeated, providing said average input current level 33, as shown in FIG. 3 by the broken centerline. Since the current 30 between the thus formed pulses does not reach a zero level, a high switching frequency is possible.

Certainly, the control unit 23 adapts the high and low input current levels 31, 32 to obtain the respectively desired average input current level 33. Accordingly, the control unit 23 integrates the momentary current values, obtained by input current detector 24, to determine whether the average input current corresponds to the desired average input current level 33 set by the feedback circuit 9. The high and low input current levels 31, 32 are correspondingly adapted in the case of a difference between the set and the actual average input current.

As discussed above, the control unit 23 is configured to set the low and high input levels 31, 32 according to the average input current level 33 supplied by feedback circuit 9 over set-point line 25. According to the present example, the feedback circuit 9 allows switching the control unit 23 at least between a first 33*a* and a second 33*b* average input current level.

Figure 4:
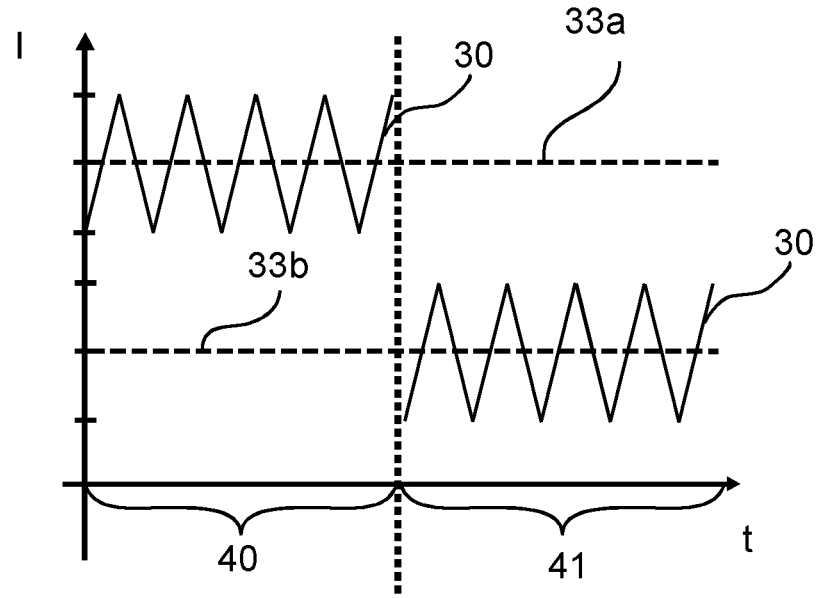

As shown in the graph of FIG. 4, the second average input current level 33*b* is lower than the first average input current level 33*a*. Accordingly, the power converter 7 can be set to a high current generating mode 40 and a low current generating mode 41. In both modes 40, 41, current pulses are drawn from the power supply 2. The moment of switching between the high current generating mode 40 and the low current generating mode 41 is indicated in FIG. 4 by the dotted line.

While the above-mentioned inner hysteresis operation of the control unit 23 is based on the momentary value of the input current, as determined by the input current detector 23, and on the basis of the respectively set average input current level 33*a*, 33*b*, the feedback circuit 9 comprises a second comparator and switches between the high current generating mode 40 and the low current generating mode 41 according to a second, "outer" hysteresis on the basis of the momentary value of the output lamp current 50 determined by lamp current detector 11. Accordingly, two switching operations are superimposed, each using a hysteresis for control.

Figure 5:
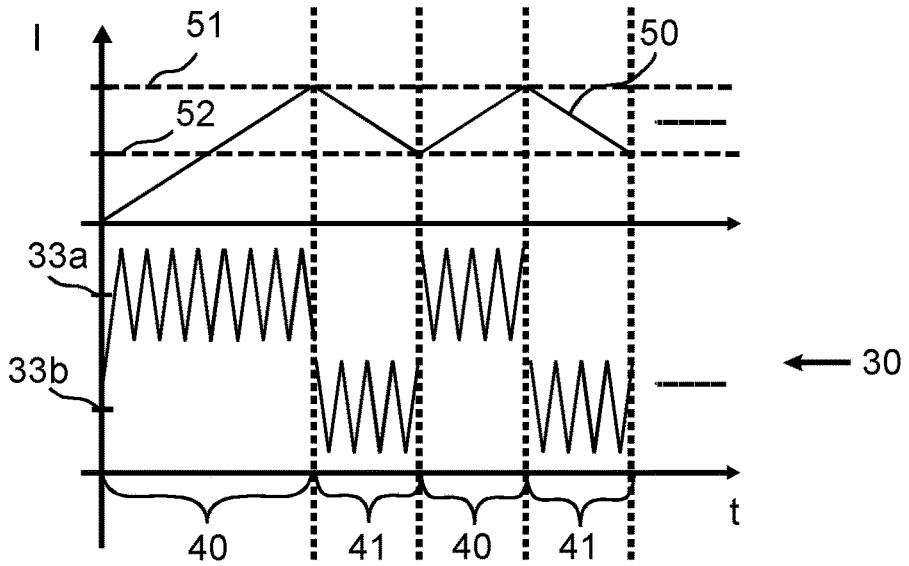
FIG. 5 shows a schematic graph of the operation of the LED retrofit driver circuit according to FIG. 2, when operating in a second operating state.

The feedback circuit 9 is adapted to set the control unit 23 to said high current generating mode 40 upon connection to power, as shown in the graph of FIG. 5. The figure shows the waveform of the input current 30, the output lamp current 50 and the respectively set high and low current generation modes 40, 41 over time.

Once the lamp current 50 reaches a maximum threshold value 51, the power converter 7 is switched to the low current generating mode 41. Accordingly, the lamp current 50 decreases. When the lamp current 50 corresponds to a minimum threshold value 52, the control unit 23 is switched from said low current generating mode 41 to said high current generating mode 40. This operation is correspondingly repeated and the duty cycle of the switching between the high and low current generating modes 40, 41 is adapted so as to correspond to the power consumption of the LED unit 5.

The minimum and maximum threshold values 51, 52, i.e. the set points, are stored in a memory of the feedback circuit 9 and correspond to the maximum and minimum allowable current of the LED unit 5, so that the lamp current 50 stays within the nominal operating range of the LED unit 5. Alternatively or additionally, the feedback circuit 9 may be adapted for dimming operations, e.g. using a corresponding user interface (not shown). In this case, the minimum and maximum threshold values 51, 52 correspond to the desired dimming level.

Accordingly, the setup of the LED retrofit driver circuit 3 provides two hysteresis control operations, namely a first, inner hysteresis operation on the input current 30, using the control unit 23, and a second, outer hysteresis operation on the output lamp current 50, using the feedback circuit 9. The LED retrofit driver circuit 3 thus allows operation in a first and a second operating state, as will be discussed in the following with reference to FIGS. 5 and 6.

Due to the setup of the present embodiment of the LED retrofit driver circuit 3, operation of the LED unit 5 is advantageously possible with a variety of different types of power supplies 2 and under various load conditions. The LED retrofit driver circuit 3 thus can be advantageously used for retrofit applications and in particular without detailed knowledge of the specific type of power supply 2 installed.

In particular, when operating the LED retrofit driver circuit 3 with an electronic halogen electronic transformer as the power supply 2, two major groups of transformers are typically installed. A first group exhibits a relatively high minimum load requirement, which typically is higher than the current needed for operation of the LED unit 5 and the second average input current level 33*b*. A second group exhibits no or only a relatively low minimum load or current requirement.

The present embodiment advantageously allows operation according to a first and a second operating state, which is set in dependence on the type or group of power supply 2 connected.

Figure 7:
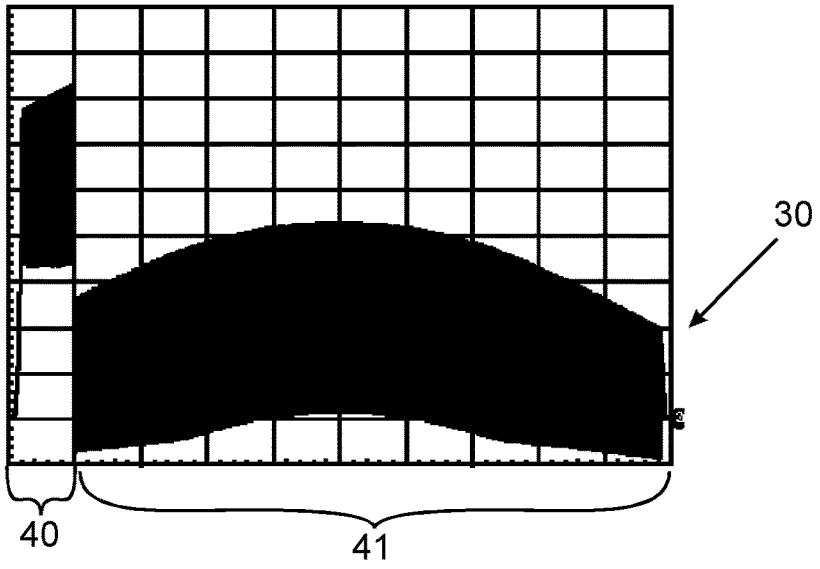
FIG. 7 shows a further example of the operation in the second operating state in a schematic graph.

In a second operating state, i.e. when the LED retrofit driver circuit 3 is connected to a power supply 2 of said second group, the power supply 2 allows operation in the high and the low current generating modes 40, 41, since the minimum current requirement of such a power supply 2 is lower than the second average input current level 33*b*. This situation corresponds to the operation shown in FIG. 5. FIG. 7 shows a graph according to a second example of operation in said second operating state. Here, the input current 30 is shown over a half-cycle of the provided alternating voltage (not shown). As will become apparent from the figure, the switching frequency of the hysteresis operation of control unit 23 is relatively high, which is why the waveform of the current 30 appears as a "solid" block. In the example of FIG. 7, it is further shown that the feedback circuit 9 is adapted to switch between said high current generating mode 40 and said low current generating mode 41 only once per half-cycle of the alternating voltage.

Figure 6:
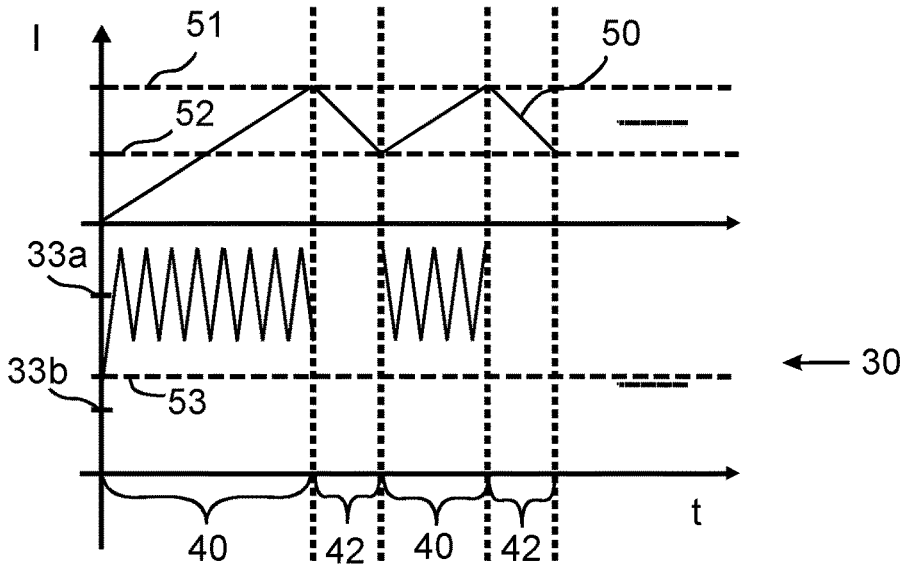
FIG. 6 shows a schematic graph of the operation of the LED retrofit driver circuit according to FIG. 2, when operating in a first operating state.

In said first operating state, i.e. in the case that the LED retrofit driver circuit 3 is connected to a power supply 2 of said first group, no input current 30 is present when the power converter 7 is set to the low current generating mode, which is hereinafter referred to as OFF mode 42. As shown in the graph of FIG. 6, the minimum current requirement 53 of such a power supply 2 is higher than the second average input current level 33*b*. Accordingly, no input current is provided in the OFF mode 42, which apparently increases the duty cycle of the switching operation between the high current generating mode 40 and said OFF mode 42.

Figure 8:
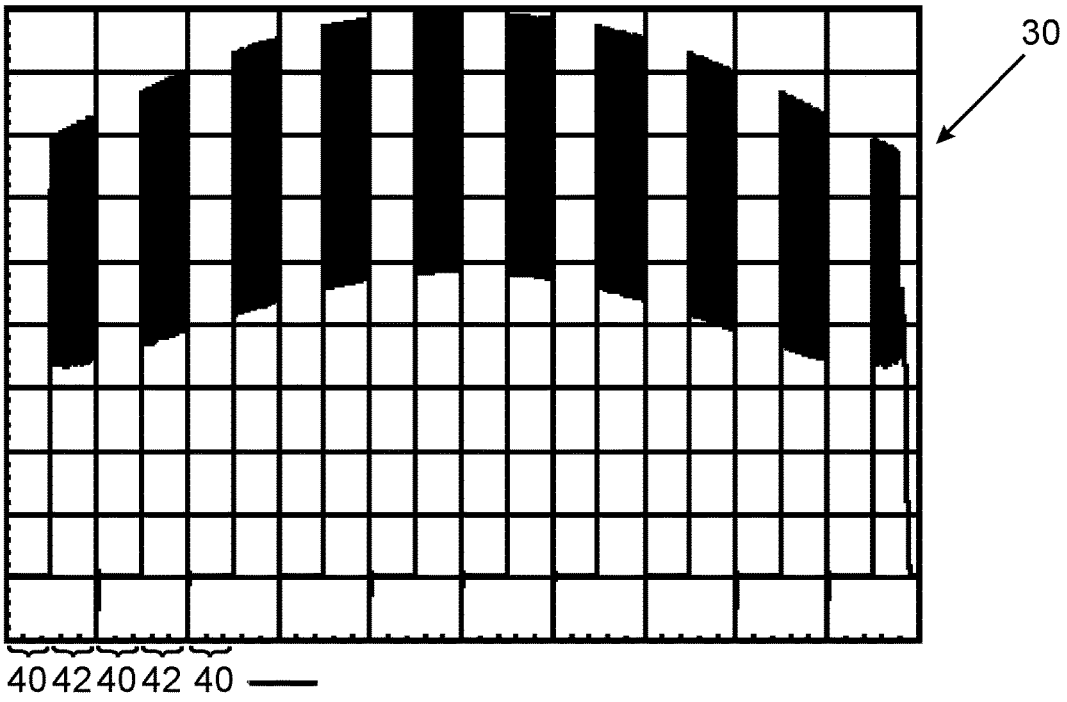
FIG. 8 shows a further example of the operation in the first operating state in a further schematic graph.

In correspondence with FIG. 7, FIG. 8 shows a graph of the input current 30 in said first operating state for the duration of a half-cycle of the alternating voltage. Again, the switching frequency of the inner hysteresis operation of the control unit 23 is relatively high, so that the waveform of the current 30 appears as a solid block. Due to the fact that the lamp current 50 decreases fast during the OFF mode 42, the feedback circuit 9 switches between the high current generating mode 40 and the OFF mode 42 several times per half-cycle, resulting in a high duty cycle, as mentioned above.

While operation of the LED retrofit driver according to FIG. 8 substantially corresponds to that disclosed in the prior published patent application WO 2011/033415 of the present applicant, incorporated herein by reference, the present embodiment further allows said second operating state, in the case that a power supply 2 is connected, having a relatively low or no minimum current requirement. As will become apparent from a comparison of FIGS. 8 and 7, the current flow angle, i.e. the time in each half-cycle during which a current is drawn from the connected power supply 2, is higher in the second operating state according to FIG. 7. Thus, in this mode, the power factor of the overall setup, and hence the electrical efficiency, is advantageously increased. Furthermore, the LED retrofit driver circuit 3 also allows operating a power supply 2 with a high minimum current requirement in the first operating state according to FIG. 8 and selecting the most appropriate operating state automatically. Therefore, the LED retrofit driver circuit 3 advantageously is versatile.

While the invention has been illustrated and described in detail in the drawings and foregoing description, such illustration and description are to be considered illustrative or exemplary and not restrictive; the invention is not limited to the disclosed embodiments. For example, it may be possible to operate the invention in an embodiment in which:

- in the embodiment of FIGS. 1 and 2, the power converter 7 is integrated with the feedback circuit 9 and/or the averaging circuit 10,
- the control unit 23 and/or the feedback circuit 9 comprise a suitably programmed microcontroller or computing unit to provide the respective operation, and/or
- the rectifier 12, instead of being comprised in the power converter 7, is comprised in the power supply 2.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An LED retrofit driver circuit comprising:

an input for receiving an operating voltage from a power supply;

an output for connection to one or more LED units;

a power converter connected with said input and said output and configured to provide a lamp current at said output, wherein the power converter is configured to operate in at least a first operating state, in said first operating state, the power converter being configured to switch between:

a high current generating mode, in which the power converter is configured to draw current pulses from said power supply to draw a first average input current, and an OFF mode during which no current is drawn from said power supply, wherein the power converter is configured to operate in at least a second operating state, and in said second operating state, said power converter being configured at least to operate in a low current generating mode, in which the power converter is configured to draw current pulses from said power supply to draw a second average input current, the second average input current being lower than said first average input current.

2. The LED retrofit driver circuit according to claim 1, wherein said power converter is configured to alternate between a high current level and a low input current level to draw said first and second average input current.

3. The LED retrofit driver circuit according to claim 1, wherein said power converter comprises a step-up converter to provide said lamp current from said operating voltage.

4. The LED retrofit driver circuit according to claim 1, wherein in said second operating state, the power converter is further configured to switch between said low current generating mode and said high current generating mode.

5. The LED retrofit driver circuit according to claim 1, wherein said power converter is adapted to switch between said high current generating mode, said low current generating mode and said OFF mode in synchronization with said operating voltage.

6. The LED retrofit driver circuit according to claim 1, further comprising a feedback circuit connected with said power converter and configured to determine at least one electrical parameter at said output to set the mode of said power converter in dependence on said determined parameter.

7. The LED retrofit driver circuit according to claim 6, wherein said feedback circuit is adapted to set said mode of said power converter so that the lamp current corresponds to a predefined average lamp current.

8. The LED retrofit driver circuit according to claim 6, wherein said feedback circuit is configured to switch said power converter from said high current generating mode to said low current generating mode and said OFF mode, when said determined electrical parameter corresponds to a maximum threshold value.

9. The LED retrofit driver circuit according to claim 8, wherein said feedback circuit is configured to switch said power converter from said low current generating mode and/or said OFF mode to said high current generating mode, when said determined electrical parameter corresponds to a minimum threshold value.

10. The LED retrofit driver circuit according to claim 9, wherein an averaging circuit is provided, connected with said feedback circuit to set at least one of said maximum and minimum threshold value.

11. An LED retrofit lamp comprising at least a LED retrofit driver circuit according to claim 1 and one or more LED units connected with said LED retrofit driver circuit.

12. An LED lighting system comprising a LED retrofit lamp according to claim 11 and a power supply connected to said input of said driver circuit and having a minimum current requirement lower than said second average input current, so that, during operation, said power converter is switched between said low current generating mode and said high current generating mode.

13. A method of operating an LED retrofit driver circuit, said driver circuit comprising an input for receiving an operating voltage from a power supply, an output for connection to one or more LED units and a power converter connected with said input and said output and configured to provide a lamp current at said output during operation, in a first operating state, the power converter is switched between a high current generating mode, in which current pulses are drawn from said power supply to draw a first average input current, and an OFF mode in which no current is drawn from said power supply, wherein in a second operating state, the power converter operates in a low current generating mode in which a current is drawn from said power supply to draw a second average input current lower than said first average input current.

* * * * *